US007398031B2

(12) United States Patent
Matsuura

(10) Patent No.: US 7,398,031 B2
(45) Date of Patent: Jul. 8, 2008

(54) IMAGE FORMING APPARATUS WITH HEAT CONTROL OF IMAGE BEARING MEMBER

(75) Inventor: Daigo Matsuura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 344 days.

(21) Appl. No.: 11/300,497

(22) Filed: Dec. 15, 2005

(65) Prior Publication Data

US 2006/0140663 A1 Jun. 29, 2006

(30) Foreign Application Priority Data

Dec. 28, 2004 (JP) ..... 2004-381909

(51) Int. Cl.
*G03G 15/00* (2006.01)

(52) U.S. Cl. ..... 399/96

(58) Field of Classification Search ..... 399/44, 399/91, 92, 94, 96, 159
See application file for complete search history.

(56) References Cited

U.S. PATENT DOCUMENTS

| | | | | |
|---|---|---|---|---|
| 4,367,036 | A * | 1/1983 | Sakamaki et al. | 399/96 |
| 4,585,319 | A * | 4/1986 | Okamoto et al. | 399/96 |
| 4,659,206 | A * | 4/1987 | Kai et al. | 399/96 |
| 5,019,862 | A * | 5/1991 | Nakamura et al. | 399/44 |
| 5,689,768 | A | 11/1997 | Ehara et al. | 399/96 |
| 7,231,155 | B2 * | 6/2007 | Suzuki | 399/44 |
| 2006/0210288 | A1 | 9/2006 | Hayashi et al. | 399/33 |

FOREIGN PATENT DOCUMENTS

| | | |
|---|---|---|
| JP | 64-34205 | 3/1989 |
| JP | 1-237587 | 9/1989 |
| JP | 8-76641 | 3/1996 |
| JP | 8-160821 | 6/1996 |
| JP | 8-171337 | 7/1996 |
| JP | 2002-333153 | 11/2002 |

* cited by examiner

*Primary Examiner*—William J. Royer
(74) *Attorney, Agent, or Firm*—Fitzpatrick, Cella, Harper & Scinto

(57) ABSTRACT

An image forming apparatus has an image bearing member on which an electrostatic latent image is formed and toner deposited to form a toner image, a heater disposed at a position out of contact with the surface of the image bearing member to output radiant heat to the image bearing member, and a heat controller for controlling rotation of the image bearing member and heat output by the heater to heat the outer peripheral surface of the image bearing member moving relative to the heater. The heater includes a lamp heater having a radiation spectrum that exhibits a major part of the peak intensity in the range of infrared wavelength from 2 to 3.5 μm.

7 Claims, 9 Drawing Sheets

FIRST EMBODIMENT

REFERENCE

FIG. 7

| HEATER | NIGHTTIME POWER | POWER CONSUMPTION | IMAGE DELETION | TONER ADHESION |
|---|---|---|---|---|
| INTERNAL NICHROME WIRE | ON | POOR | GOOD | GOOD |
| INTERNAL NICHROME WIRE | OFF | GOOD | POOR | GOOD |
| HALOGEN LAMP | OFF | GOOD | ADEQUATE | POOR |
| CARBON LAMP 31P | OFF | GOOD | GOOD | ADEQUATE |
| CARBON LAMP 31 | OFF | GOOD | GOOD | GOOD |

IMAGE FORMING APPARATUS WITH HEAT CONTROL OF IMAGE BEARING MEMBER

BACKGROUND OF THE INVENTION

1. Field of the Invention

The present invention relates to an image forming apparatus, such as a copying machine, a printer, or a facsimile, that forms an image by means of electrophotography.

2. Description of the Related Art

An image forming apparatus that forms an image by means of electrophotography includes a photosensitive drum serving as an image bearing member and a plurality of corona chargers arranged around the photosensitive drum. The plurality of corona chargers include a primary charger, a pre-transfer charger, a transfer charger, and a detach charger.

When activated, these corona chargers generate active substances (e.g., ozone and oxides of nitrogen). Some of these active substances change the chemical composition and the crystalline structure of the surface of the photosensitive drum. The change in the chemical composition and the crystalline structure of the surface may increase the hygroscopic property of the surface, and therefore, the electrical specific resistance of the surface area may decrease. Accordingly, the electrostatic charge retention properties of the drum may deteriorate, thus decreasing the quality of a formed image. In particular, when the photosensitive drum is left unused in a high-humidity environment for a long period of time due to being in a power-off mode or power-saving mode, moisture absorption of the photosensitive drum occurs at linear zones facing the corona chargers in a concentrated manner. Because a difference in the electrostatic charge retention function between the zones facing and not facing the corona chargers exists, uneven density or some defects may appear in the output image.

To solve this problem, it has been proposed that the photosensitive drum always be rotated to prevent the decrease in the electrostatic charge retention functions in particular zones. It has also been proposed that a heater be provided in a photosensitive drum and the heater is always in a power-on mode so as to uniformly heat the whole unoperated photosensitive drum. Thus, the photosensitive drum is prevented from absorbing moisture.

For example, a copying machine disclosed in Japanese Examined Utility Model Registration Application Publication No. 1-34205 includes a hollow photosensitive drum. Heated air is externally delivered to the hollow photosensitive drum so as to evenly heat the whole photosensitive drum.

A color printer disclosed in Japanese Patent Laid-Open No. 8-76641 includes a photosensitive drum having a roller-shaped heater on the outer periphery thereof. By rotating the photosensitive drum, the entire surface of the photosensitive drum can be evenly heated.

Copying machines disclosed in Japanese Patent Laid-Open No. 8-160821 and Japanese Patent Laid-Open No. 8-171337 include a heating element having an elongated plate shape at a position slightly spaced away from a photosensitive drum so as to heat the photosensitive drum across an air layer. At start-up time, the heating element enters a power-on mode so as to heat the air layer while rotating the photosensitive drum. Thus, the entire surface of the photosensitive drum is heated so as to eliminate the moisture.

When a resistance heating heater is provided in a photosensitive drum and is always in the power-on mode, power is consumed even during power-off time of a copying machine or printer and even out of hours. Also, an increase in cooling power at the installation location is required. This power consumption does not meet the increasing demand for power and energy conservation. Accordingly, Japanese Patent Laid-Open No. 8-160821 discloses technology in which an image forming apparatus stops the heating during power-off time or after a predetermined unoperated time period has elapsed (i.e., in a power-saving mode). When the image forming apparatus enters the power-on mode or exits the power-saving mode, the image forming apparatus starts heating prior to its printing operation so that a photosensitive drum is preheated for about 30 seconds to a couple of minutes to eliminate the moisture.

In the case of the preheating method discussed in Japanese Examined Utility Model Registration Application Publication No. 1-34205, the heat is dissipated together with the heated air, and therefore, heating efficiency is low. In addition, the temperature of the surface of the photosensitive drum does not rise rapidly, and therefore, a lengthy warm-up time is required for starting up the apparatus and starting up the printing process.

In the case of the preheating method discussed in Japanese Patent Laid-Open No. 8-76641, since the roller heater having a high temperature is in direct contact with the photosensitive drum, there is the possibility that toner will be heat-sealed on the surface of the photosensitive drum in the contact area or toner which inhibits heat conduction will be deposited onto the roller heater.

Additionally, in the case of the preheating method discussed in Japanese Patent Laid-Open No. 8-160821 and Japanese Patent Laid-Open No. 8-171337, the photosensitive drum is not in contact with the heater. Accordingly, the problem caused by the contact between the photosensitive drum and the heater does not occur. However, since the heat is transferred by an air layer, the heating efficiency is low. Thus, the temperature of the surface of the photosensitive drum rises slowly despite high power consumption of the heating element. If the power consumption of the heating element is increased to speed up the temperature rise, electric elements and components around the heating element are unnecessarily heated, and therefore, an additional cooling fan is required to cool an electronic circuit in the image forming apparatus.

The present inventor conducted an experiment in which the heating element was substituted by a halogen lamp heater, which was disposed at a position spaced slightly away from a photosensitive drum to eliminate the moisture by means of a radiant heating method. In this case, since the halogen lamp heater is not in contact with the photosensitive drum, the problems caused by the contact, such as a toner adhesion problem, do not occur. In addition, since the heat conduction does not rely on the air, high heating efficiency can be obtained. However, a typical halogen lamp heater equally disperses radiation throughout 360 degrees. Accordingly, in this experiment, parts and units adjacent to the halogen lamp heater (e.g., a cleaning unit and a developer unit) were unnecessarily heated, as will be described below. Thus, it was found that toner adhered to these parts and units.

SUMMARY OF THE INVENTION

The present invention provides an image forming apparatus for efficiently eliminating moisture on the surface of a photosensitive drum by heating the surface in a short time with minimal power consumption. The present invention also provides an image forming apparatus that eliminates a problem caused by heat being applied to parts other than the photosensitive drum by reducing the heat applied to those parts.

According to an embodiment of the present invention, an image forming apparatus includes an image bearing member on which an electrostatic latent image formed on a surface of the image bearing member has deposited toner for forming a toner image, heating means disposed at a position out of contact with the surface of the image bearing member, the heating means outputting radiant heat to the image bearing member, and heat control means for controlling rotation of the image bearing member and radiation output of the heating means to heat the outer peripheral surface of the image bearing member moving relative to the heating means. The heating means includes a lamp heater whose radiation spectrum exhibits a major part of the peak intensity in the range of infrared wavelength from 2 to 3.5 μm.

According to another embodiment of the present invention, an image forming apparatus includes an image bearing member on which an electrostatic latent image formed on a surface of the image bearing member has deposited toner for forming a toner image, heating means disposed at a position out of contact with the surface of the image bearing member, the heating means outputting radiant heat to the image bearing member, and heat control means for controlling rotation of the image bearing member and radiation output of the heating means to heat the outer peripheral surface of the image bearing member moving relative to the heating means. The heating means includes a lamp heater including a heating element enclosed in a glass tube, the heating element when powered on outputting radiant heat through the wall of the glass tube, and the lamp heater has a distribution of anisotropic radiation intensity and outputs radiant heat in a specific direction throughout a 360-degree periphery of the cross section of the lamp heater so that an amount of radiant heat directed to the image bearing member is higher than an amount of radiant heat directed to the circumferential direction of the image bearing member.

According to yet another embodiment of the present invention, an image forming apparatus includes an image bearing member on which an electrostatic latent image formed on a surface of the image bearing member has deposited toner for forming a toner image, heating means disposed at a position out of contact with the surface of the image bearing member, the heating means outputting radiant heat to the image bearing member, and heat control means for controlling rotation of the image bearing member and radiation output of the heating means to heat the outer peripheral surface of the image bearing member moving relative to the heating means. The heating means includes a lamp heater including a carbon heating element enclosed in a glass tube and the carbon heating element when powered on is heated so as to emit radiant heat through the wall of the glass tube.

In the image forming apparatus according to an embodiment of the present invention, heating means operates to relatively move an image bearing member while emitting radiant heat to the image bearing member so as to heat and dehumidify the outer periphery of the image bearing member.

A lamp heater element provides large radiation energy in the wavelength range of 2 to 3.5 μm that increases energy absorption efficiency of water molecules. Accordingly, the heating efficiency (evaporation humidification) of moisture per total amount of radiation heat becomes high. In addition, since the lamp heater element heats a member including moisture more efficiently than a member excluding moisture, the lamp heater element can selectively heat the surface layer of the image bearing member in a concentrated manner before the temperature of metallic parts in the vicinity rises.

In other words, by selecting a lamp heater element whose radiation spectrum is suitable for heating moisture, its radiant heat energy can be absorbed in a concentrated manner by a moisture area of the image bearing member. Even when light shielding and heat insulation are not provided, the absorption of the radiant heat energy by metallic parts and units having no moisture in the vicinity is relatively low.

That is, in the case of a nichrome heater and a halogen lamp heater, the temperature of the material of the image bearing member rises first and, subsequently, the temperature of water molecules that receive the heat energy rises so as to evaporate the water molecules. However, in the case of the lamp heater element whose radiation spectrum is suitable for heating moisture, the radiant heat energy is directly absorbed by the water molecules. Accordingly, even when the temperature of the image bearing member is low, the water molecules evaporate or are released from a compound in a short time.

Consequently, the lamp heater element does not overheat the parts in the vicinity of the lamp heater element. Also, the lamp heater element can rapidly remove moisture from the moisture area of the image bearing member without overheating the image bearing member itself.

According to still another aspect of the present invention, a carbon heater lamp that has an anisotropic heat radiation property with the highest radiation intensity in a specific direction is arranged so that the direction providing the highest radiation intensity coincides with a direction towards the image bearing member. When the image forming apparatus starts up from a power-off mode, the moving speed of the image bearing member is decreased compared to that during an image forming operation so as to increase the temperature rising speed of the surface layer of the image bearing member.

Further features of the present invention will become apparent from the following description of exemplary embodiments with reference to the attached drawings.

BRIEF DESCRIPTION OF THE DRAWINGS

FIG. 7 illustrates the results of experiments.

DESCRIPTION OF THE EMBODIMENTS

First Exemplary Embodiment

Figure 1:
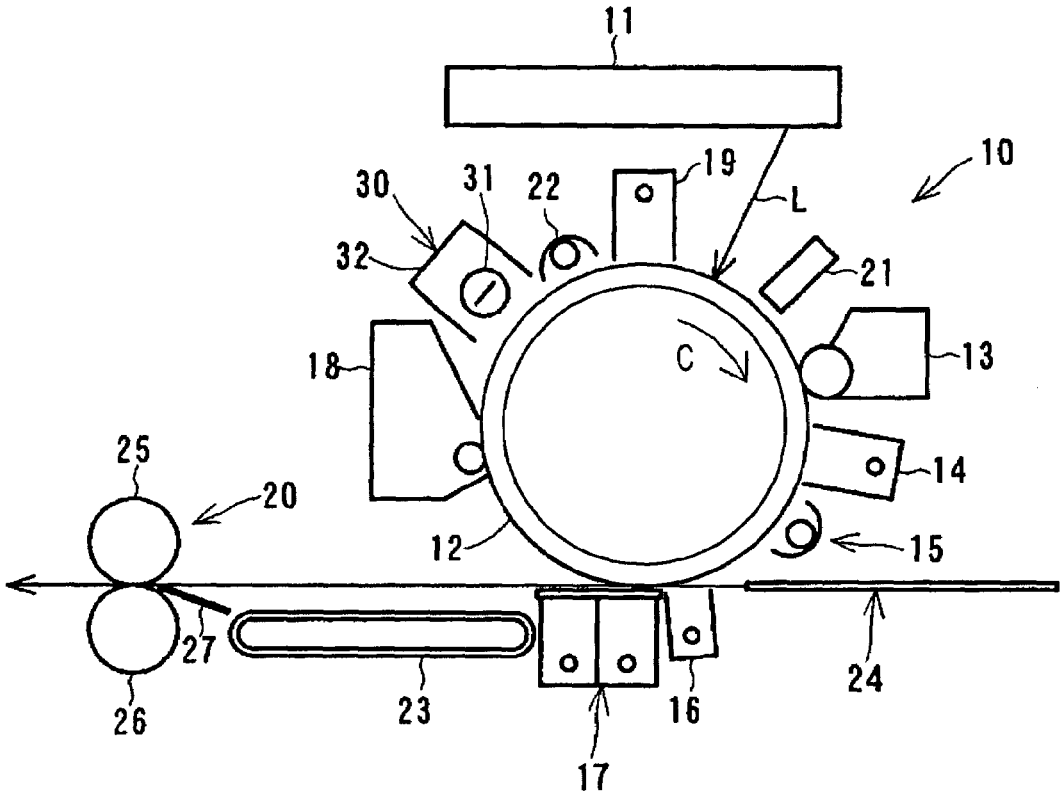
FIG. 1 is a block diagram of an image forming apparatus according to a first exemplary embodiment of the present invention.
Figure 2:
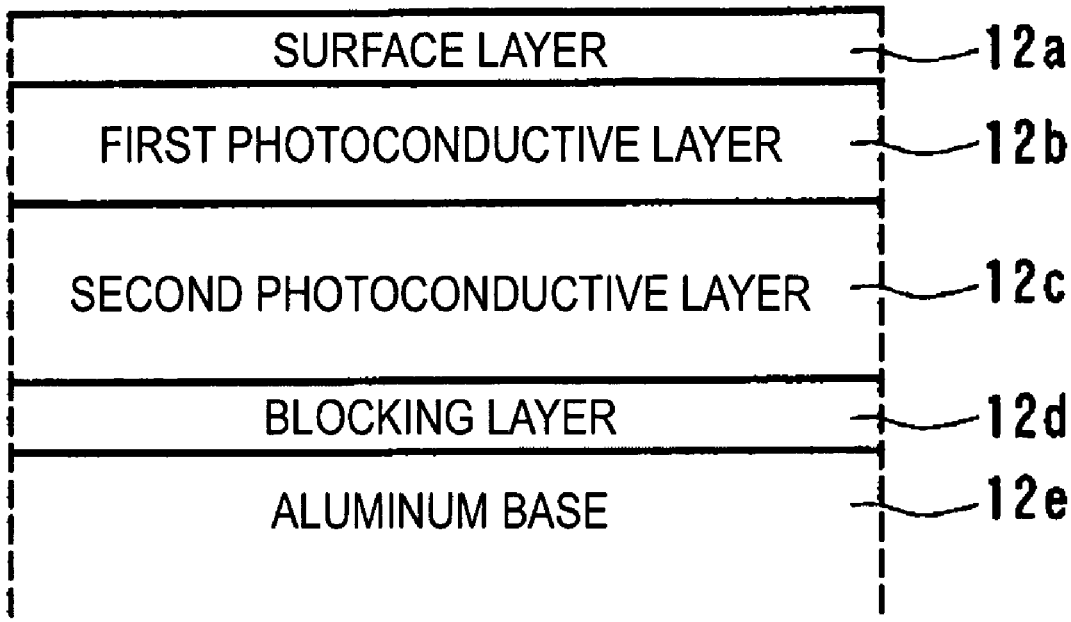
FIG. 2 illustrates the surface structure of a photosensitive drum.
Figure 3:
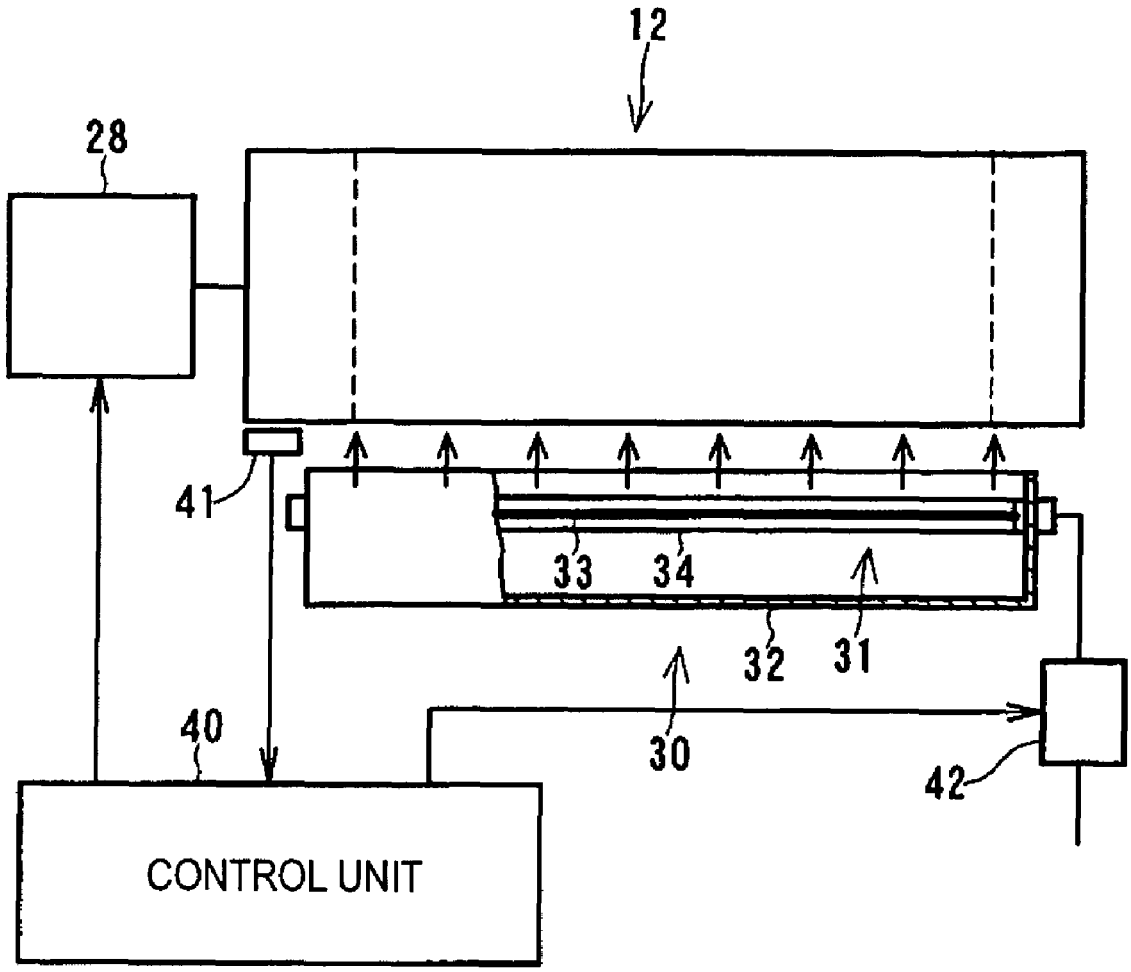
FIG. 3 is a diagram illustrating the heating control process of the photosensitive drum.
Figure 4:
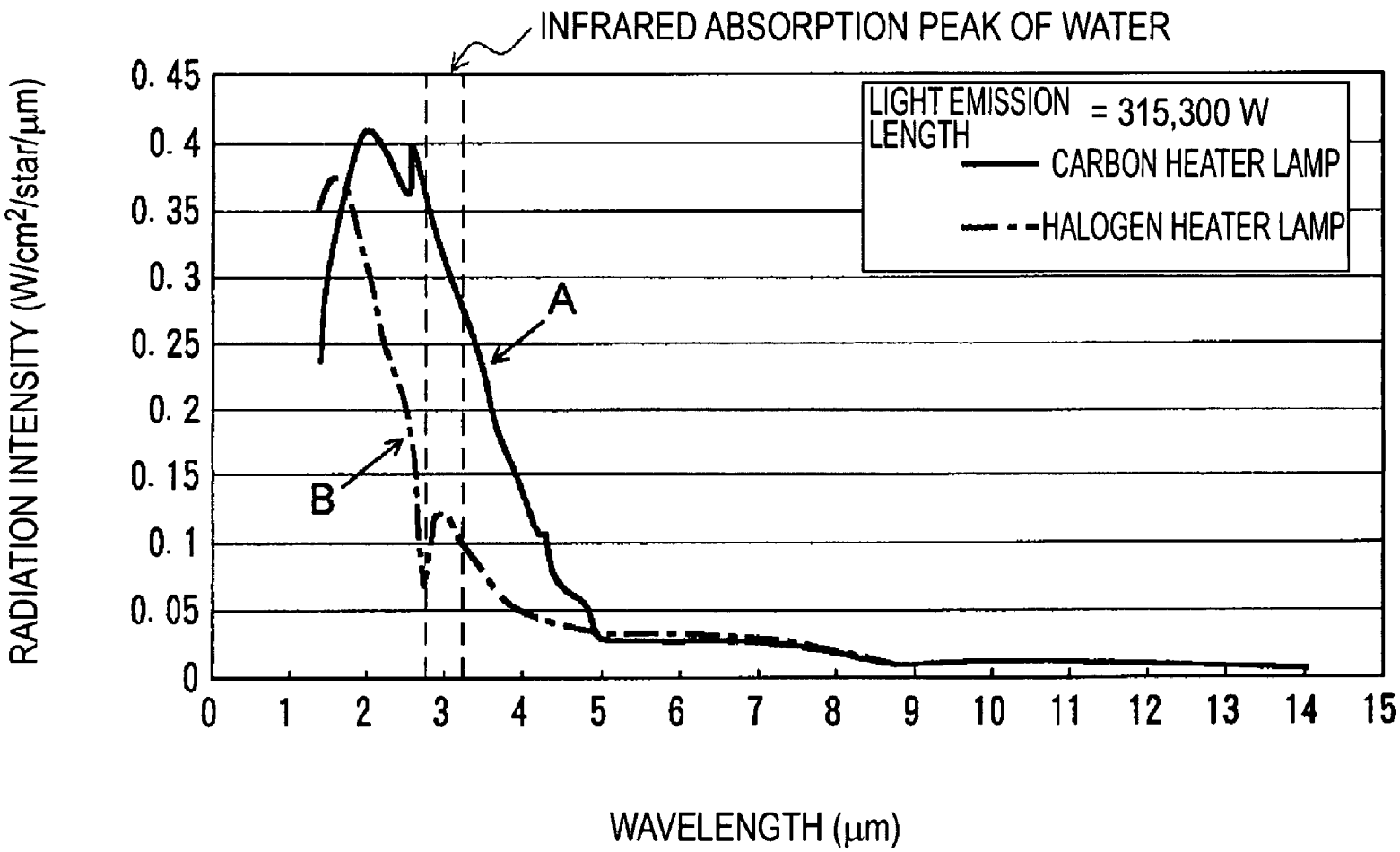
FIG. 4 is a diagram illustrating the radiation spectrum of a carbon lamp heater.

FIG. 1 is a block diagram of an image forming apparatus according to a first exemplary embodiment of the present invention. FIG. 2 illustrates the surface structure of a photosensitive drum. FIG. 3 is a diagram illustrating the heating control process of the photosensitive drum. FIG. 4 is a diagram illustrating the radiation spectrum of a carbon lamp heater. FIG. 5 illustrates the distribution of the anisotropic radiation intensity of the carbon lamp heater. FIG. 6 is a flow chart of the heating control process.

According to this embodiment, as shown in FIG. 1, an image forming apparatus 10 (an electrophotographic monochrome laser beam printing apparatus) includes a photosensitive drum 12 (image bearing member) adjacent to a transport path of a sheet of material (transfer material) 24. The image forming apparatus 10 further includes a discharge exposure lamp 22, a primary charger 19, an exposure unit 11, an electric potential sensor 21, a developer unit 13, a pre-transfer charger 14, a pre-transfer exposure lamp 15, a cleaning unit 18, and a heating unit 30, all of which are arranged around the photosensitive drum 12.

On the transport path of the sheet of material 24, a transfer charger 16 and a detach charger 17 are arranged at positions opposed to the photosensitive drum 12. Downstream of a conveyor transport unit 23 is a fusing entrance guide 27 and a fuser unit 20. The fuser unit 20 includes a heating/fusing roller 25 and a pressure roller 26.

When forming an image, the photosensitive drum 12 is driven by a driving unit 28 (see FIG. 3) disposed on the back side of the photosensitive drum 12 to rotate in a direction shown by an arrow C of FIG. 1 (clockwise direction) at a predetermined circumferential velocity (a process speed: a printing speed V0). The sheet of material 24 in contact with the photosensitive drum 12 is transported, from right to left, to the conveyor transport unit 23.

The primary charger 19 applies a charge of a predetermined polarity and level over the surface of the photosensitive drum 12 using an applied charge bias. Exposure unit 11 generates an exposure laser beam L which scans the surface of the photosensitive drum 12 in accordance with image information to create an electrostatic latent image. At that time, a charge at a point on the surface of the photosensitive drum 12 exposed to the exposure laser beam L is discharged so that the electric potential of that point decreases. Thus, the electrostatic latent image is created on the surface of the rotating photosensitive drum 12 in accordance with the input image information.

The electric potential sensor 21 measures the surface potential of the photosensitive drum 12 and feeds it back to the primary charger 19 and the exposure unit 11 to change the drive conditions.

The developer unit 13 applies toner charged with the same polarity as that of the photosensitive drum 12 to the electrostatic latent image so as to visualize (develop) a toner image. The pre-transfer charger 14 enhances the charge polarity of the toner image. The pre-transfer exposure lamp 15 decreases the charge in areas of the photosensitive drum 12 which are not covered by the toner image to facilitate the transfer of the toner image onto the sheet of material 24 and the separation of the sheet of material 24 from the photosensitive drum 12.

The transfer charger 16 charges the sheet of material 24 with a reverse polarity from that of the toner to form a transfer bias. The transfer bias moves (transfers) the toner image formed on the photosensitive drum 12 onto the sheet of material 24. After the transfer is carried out, the detach charger 17 removes remaining the charge on the sheet of material 24 and generates a separation charge bias on the sheet of material 24 to separate the sheet of material 24 from the photosensitive drum 12.

The sheet of material 24 separated from the surface of the photosensitive drum 12 is transported to the fusing entrance guide 27 by the conveyor transport unit 23 and is delivered into the fuser unit 20. The fuser unit 20 delivers the sheet of material 24 into a nip defined by the highly heated heating/fusing roller 25 and the pressure roller 26. Subsequently, the sheet of material 24 is output to outside the image forming apparatus 10. At that time, the heat of the heating/fusing roller 25 fuses the toner onto the surface of the sheet of material 24 to fix the toner image on the sheet of material 24.

As for the photosensitive drum 12 after the toner image is transferred to the sheet of material 24, to prepare for the next image forming operation, the cleaning unit 18 is brought into contact with the photosensitive drum 12 to remove the remaining toner. The discharge exposure lamp 22 emits light to the surface of the photosensitive drum 12 to remove the residual electrostatic charge on the surface of the photosensitive drum 12.

The photosensitive drum 12 includes an aluminum cylinder having a diameter of about 80 mm and having an amorphous silicon (a-Si) photoconductive layer formed on the outer periphery of the aluminum cylinder. As shown in FIG. 2, a blocking layer 12*d*, a second photoconductive layer 12*c*, a first photoconductive layer 12*b*, and a surface layer 12*a* are layered on a conductive aluminum base 12*e* in this order. Each of the layers 12*d* to 12*a* is less than or equal to 100 μm in thickness.

The second photoconductive layer 12*c* and the first photoconductive layer 12*b* are primarily formed from an amorphous silicon material in which the silicon atom is bonded to the hydrogen atom and the halogen atom. The surface hardness of the photosensitive drum 12 is about 2000 $Kg/mm^2$. The life of the photosensitive drum 12 is estimated to be more than or equal to 300,000 A4 pages.

Each of the primary charger 19, the pre-transfer charger 14, the transfer charger 16, and the detach charger 17 is a corona charger although these chargers have a difference in the polarity of charge and an AC/DC driving method.

When activated, these corona chargers generate active substances (corona products), such as ozone and oxides of nitrogen. In the case where moisture is absorbed in the surface layer of the photosensitive drum 12 or in the case of a high humidity environment, the surface of the surface layer 12*a* may be chemically broken down (oxidized). Alternatively, the surface of the surface layer 12*a* easily absorbs the active substances. Accordingly, the photoconductive performance may deteriorate.

More specifically, the corona discharge energy changes gas or moisture in the air into active substances, which in turn changes the surface substance of the photosensitive drum 12 into a hydrophilic compound, such as a nitrogen compound, an aldehyde group, or a carboxyl group. If the surface of the photosensitive drum 12 is oxidized, the hygroscopic property of the surface increases. The moisture deposited on the surface is electrolyzed by the active substance so as to increase the electrical conductivity of the surface. The decrease in surface resistance caused by moisture decreases the electrostatic charge performance of the photosensitive drum 12 and the electrostatic latent image forming performance. Thus, the quality of the transferred image (print quality) deteriorates.

In an example of such an image defect, the properties of only linear areas (band-shaped areas) of the surface facing the corona chargers are degraded, thus generating a print image of uneven density. This uneven density of the print image is referred to as an "image deletion". The image deletion is a phenomenon in which corona products generated during the operation of the image forming apparatus 10 and accumulated in the corona chargers are deposited onto the areas of the photosensitive drum 12 facing the corona chargers when the main power is off (e.g., at night) and the deposited corona products delete partial transferred images in a band shape. The image deletion is noticeable when the ambient relative humidity exceeds 50 to 60%.

If the image forming apparatus 10 is left unused overnight in a high-humidity environment, after a printing operation has been completed, uneven moisture absorption on the surface of the photosensitive drum 12 will be promoted. Accordingly, during the first printing operation after the overnight non-operation, the occurrence rate of the image deletion is the highest.

A corona charger that is applied using an alternating current and a negative voltage generates more corona products. Accordingly, the area of the photosensitive drum 12 facing such a corona charger exhibits more noticeable image deletion. Since an amorphous silicon photosensitive drum employed for an image forming apparatus that requires high-speed printing (e.g., high-speed copying machine) has a high surface hardness of 1500 to 2000 $Kg/mm^2$, a low-resistance layer formed from hydrophilic oxides is negligibly polished away. Thus, significant image deletion easily occurs on such an amorphous silicon photosensitive drum.

To solve this problem, the image forming apparatus 10 of the first embodiment includes the heating unit 30 downstream from the cleaning unit 18 to heat the entire surface layer of the photosensitive drum 12 and remove moisture by rotating the photosensitive drum 12 with the heating unit 30 activated when the image forming apparatus 10 starts up from a power-off mode or when the image forming apparatus 10 resumes operation from a power-saving mode.

As shown in FIG. 3, the heating unit 30 includes a carbon lamp heater 31 covered by a reflecting plate 32. The carbon lamp heater 31 has a rated power of 300 watts. The carbon lamp heater 31 has a length corresponding to the image-forming width of the photosensitive drum 12. The carbon lamp heater 31 includes a straight pipe-shaped enclosure 34 composed of silica glass, which includes an elongated cylinder shaped carbon heating element 33. Both ends of the carbon heating element 33 are supported by power feeder units provided at both ends of the enclosure 34. The enclosure 34 seals the carbon heating element 33. Argon gas is encapsulated in the enclosure 34.

The carbon lamp heater 31 is electrically connected to a power supply unit (not shown) via a switch 42. A control unit 40 controls power on and off of the carbon lamp heater 31 via the switch 42.

The control unit 40 performs overall control of each unit of the image forming apparatus 10 of this embodiment so as to execute a printing process. In the vicinity of the surface of the photosensitive drum 12, a temperature sensor 41 composed of a non-contact thermistor is disposed to detect the surface temperature of the photosensitive drum 12. The control unit 40 (heating control means) controls power on and off to the carbon lamp heater 31 on the basis of temperature information detected by the temperature sensor 41 so as to maintain the surface temperature of the photosensitive drum 12 at 40° C. during the printing process.

When the image forming apparatus 10 starts up from a power-off mode or when the image forming apparatus 10 resumes operation from a power-saving mode, the control unit 40 references the output of the temperature sensor 41 and further controls the driving unit 28 and the switch 42 to rotate the photosensitive drum 12 while the heating unit 30 emits radiant heat to the photosensitive drum 12. Thus, the moisture on photosensitive drum 12 is eliminated by heating without toner being deposited on the photosensitive drum 12 in the developer unit 13 and the cleaning unit 18. As used herein, the term "power-saving mode" is referred to as a mode in which the temperature of the fuser unit 20 is reduced or the fuser unit 20 is powered off to save the electric power after the control unit 40 does not receive a user print instruction via an operation unit (not shown) or a print command from an externally connected apparatus for a predetermined time period.

As shown in FIG. 4, the carbon lamp heater 31 applied with a rated voltage provides a peak of the radiation spectrum in the near-infrared spectra range (see curve A: solid line). The major part of the peak lies in the wavelength range from 2 to 3.5 μm. This design significantly increases the performance of heating moisture. More specifically, in the radiation spectrum of the activated carbon lamp heater 31, it is desirable that the radiation intensity greater than or equal to 80% of the maximum radiation intensity lies in the wavelength range of 2 to 3.5 μm. In contrast, the peak of the radiation spectrum of a halogen lamp heater having the same power consumption is shifted towards a shorter wavelength zone (see curve B: alternate long and short dash line). Since the major part of the peak is offset from the wavelength zone of 2 to 3.5 μm, the infrared output of that zone is significantly smaller than that of the carbon lamp heater.

Accordingly, for the carbon lamp heater 31, the ratio of radiation energy in the wavelength range of 2 to 3.5 μm with respect to all the spectrum is significantly higher than that of a halogen lamp heater. Since the radiation energy in that wavelength range is efficiently absorbed by water molecules and the temperature of moisture rises so that the moisture evaporates, the carbon lamp heater 31 has a significantly higher performance for heating moisture than does a halogen lamp heater. Thus, the carbon lamp heater 31 is more suitable than a halogen lamp heater for heating moisture.

Figure 5A:
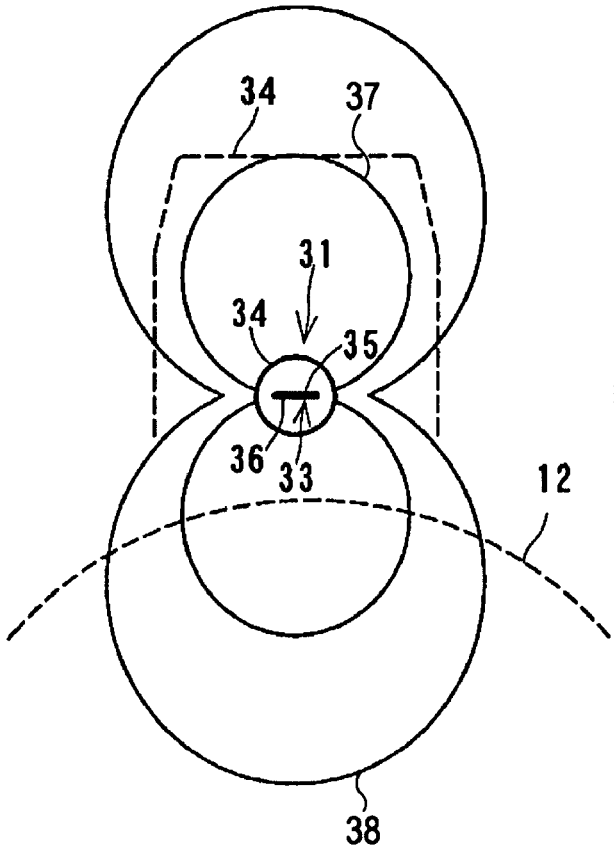
FIGS. 5A and 5B illustrate the distribution of anisotropic radiation intensity of the carbon lamp heater in the first embodiment and in a reference.
Figure 5B:
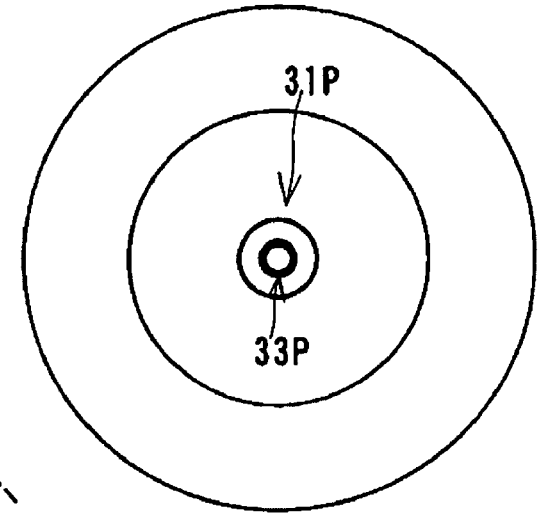
Figure 6:
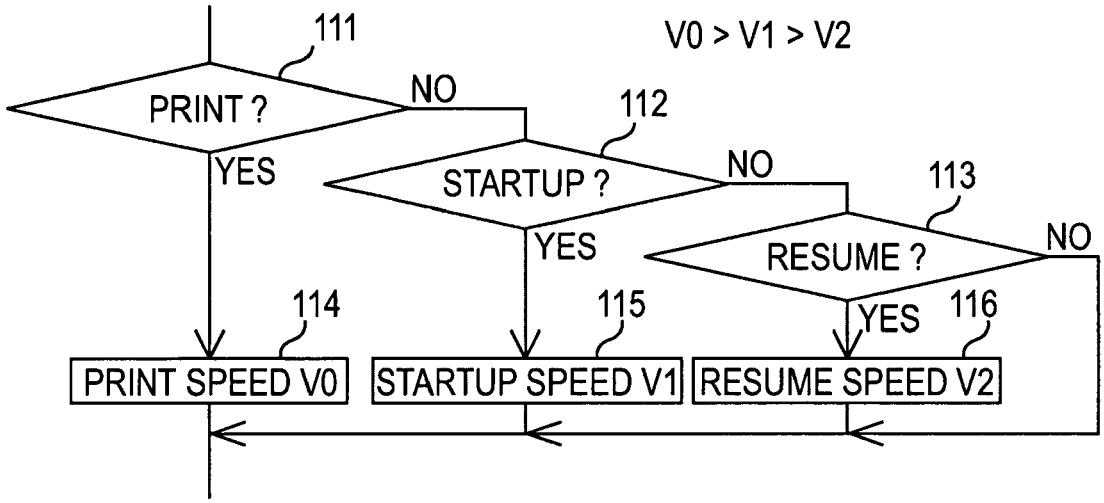
FIG. 6 is a flow chart of the heating control process.

As shown in FIG. 5A, the carbon lamp heater 31 is mounted at a position distant from the surface of the photosensitive drum 12 by about 20 mm. The carbon heating element 33 of the carbon lamp heater 31 has a flat plate shape in section and has upper and lower flat heat-radiation surfaces 35 and 36. Accordingly, as can be seen from contour lines 37 and 38 of the heating intensity, the heating intensity in a direction perpendicular to the heat-radiation surfaces 35 and 36 is high whereas the heating intensity in a direction parallel to the heat-radiation surfaces 35 and 36 is significantly low. In contrast, in FIG. 5B shown as a reference, since a typical carbon lamp heater 31P has a cylinder shape, the typical carbon lamp heater 31P has a heat radiation property in which heat is equally radiated throughout 360 degrees around the carbon lamp heater 31P.

As shown by a dashed line in FIG. 5A, in the carbon lamp heater 31, the heat-radiation surface 36 faces the photosensitive drum 12. The reflecting plate 32 is disposed on the side adjacent to the heat-radiation surface 35.

As shown in FIG. 6, the control unit 40 controls the driving unit 28 to heat the entire surface of the photosensitive drum 12 by outputting radiant heat from the carbon lamp heater 31 and by rotating the photosensitive drum 12 in either case when a printing operation is performed, when the image forming apparatus 10 starts up from a power-off mode, or when the image forming apparatus 10 resumes operation from a power-saving mode. However, the control unit 40 determines a different circumferential velocity of the photosensitive drum 12 for each case.

That is, at step 111, the control unit 40 determines whether the image forming apparatus 10 is performing a printing operation. If the image forming apparatus 10 is performing a printing operation, the control unit 40 determines a print speed to be V0 at step 114. Otherwise, the process proceeds to step 112, where the control unit 40 determines whether the image forming apparatus 10 is starting up from a power-off mode. If the image forming apparatus 10 is starting up from a power-off mode, the control unit 40 determines a startup speed to be V1 at setp 115. If the image forming apparatus 10 does not start up from a power-off mode, the process proceeds to step 113, where the control unit 40 determines whether the image forming apparatus 10 is resuming operation from a power-saving mode. If the image forming apparatus 10 is resuming operation from a power-saving mode, the control unit 40 determines a resume speed to be V2 at setp 116. It is noted that the startup speed V1 is determined to be 50% of the print speed V0, and the resume speed V2 is determined to be 10% of the print speed V0.

According to the first embodiment, in a continuous printing mode of the image forming apparatus 10 having such a configuration, the control unit 40 rotates the photosensitive drum 12 at a print speed of V0 and detects the surface temperature of the photosensitive drum 12 using the temperature sensor 41. The control unit 40 then controls on and off of the switch 42 on the basis of a switch control signal (surface temperature signal) S2 so as to maintain the surface temperature of the photosensitive drum 12 at a predetermined temperature T0 (e.g., 40° C.).

In the case of a startup from the power-off mode, the control unit 40 rotates the photosensitive drum 12 at the startup speed V1, which is lower than the print speed V0, for 6 minutes under the similar temperature control as described above.

Additionally, in the case of a resume operation from the power-saving mode, the control unit 40 rotates the photosensitive drum 12 at the resume speed V2, which is much slower than the startup speed V1, for only 30 seconds under the similar temperature control as described above.

According to the image forming apparatus 10 of the first embodiment, the heating unit 30 preheats the photosensitive drum 12 prior to image forming. Consequently, the surface of the photosensitive drum 12 is dehumidified by means of heat and the surface resistance is recovered prior to the formation of the first image. Thus, a high-quality image without image deletion can be formed.

In addition, a lamp heater element heats the photosensitive drum 12 by means of radiant heat. Consequently, a heater and a heated air path are not required in the photosensitive drum 12, and therefore, the problem of a contact-type heating unit caused by contact (e.g., contamination due to remaining toner and surface damage due to dust attraction) can be reduced. Moreover, since the heating unit can be located at a height level largely distant from the surface of the photosensitive drum 12 compared with a heating unit using air heat conduction, parts and wires around the photosensitive drum 12 can be freely arranged.

The lamp heater element at a height level distant from the surface of the photosensitive drum 12 causes a new problem that known technology prior to a lamp heater element does not cause. That is, the lamp heater unnecessarily heats up parts and units in the vicinity, as described with reference to FIG. 7.

However, the image forming apparatus 10 according to the first embodiment employs a lamp heater element that has properties suitable for heating moisture in which a main part of the radiation spectrum lies in an infrared wavelength range including the range of 2 to 3.5 μm. Consequently, the lamp heater can selectively and efficiently heat up a moisture zone (i.e., a zone causing image deletion) on the photosensitive drum 12 to eliminate the moisture. Therefore, even when the image forming apparatus 10 employs a lamp heater having a sufficiently low wattage so that the heater lamp does not heat up parts and units in the vicinity, the image forming apparatus 10 can maintain the moisture removal performance that is the same as that of a halogen lamp heater.

That is, the infrared absorption spectrum of water has a parabolic shape having a peak at a wavelength of 3 μm in the range of wavelength from 2 to 3.5 μm (i.e., a peak of the stretching vibration of the —OH group). Accordingly, by employing the carbon lamp heater 31 that has a high radiation performance in the wavelength range of 2 to 3.5 μm, moisture removal performance that is higher than or equal to that of a halogen lamp heater can be obtained by heating the photosensitive drum 12 while significantly decreasing the total radiation energy of the cleaning unit 18.

In other words, in the cases of a nichrome heater or a halogen lamp heater, the temperature of the material of the photosensitive drum 12 rises first, and, subsequently, the temperature of water molecules that receive the heat energy from the material rises. However, in the case of the carbon lamp heater 31, since the radiant heat energy is directly absorbed by the water molecules, the temperature of the water molecules abruptly rises to several hundred degrees centigrade even when the ambient temperature is about 40° C. As a result, the water molecules evaporate (or are liberated from the composition) instantaneously.

Additionally, since the radiation energy is concentrated on a small mass of the image bearing member, the temperature of a surface area which receives the radiation from the carbon lamp heater 31 rises above 40° C. even though the temperature of a surface area opposed to the temperature sensor 41, which is cooled by the entire photosensitive drum 12, is 40° C. That is, this embodiment achieves moisture removal by heating more efficiently than the case where the temperature of the entire photosensitive drum 12 is 40° C.

Furthermore, as shown in FIG. 5A, according to the image forming apparatus 10 of the first embodiment, the carbon lamp heater 31 that has the distribution of the anisotropic radiation intensity is arranged so that the peak of the radiation energy is directed to the photosensitive drum 12. Accordingly, compared with the carbon lamp heater 31P having the distribution of the isogonic radiation intensity and the same wattage, the radiant heat is more efficiently incident on the photosensitive drum 12. Therefore, compared with the carbon lamp heater 31P having the distribution of the isogonic radiation strength and the same wattage, the carbon lamp heater 31 of smaller wattage can provide moisture removal performance that is the same or more than that of the carbon lamp heater 31P.

If the wattage of a lamp heater is reduced, it follows that electric power and energy are saved. In addition, the temperature rise of the casing is prevented, thus facilitating the heat design of parts and circuits in the vicinity of the heater. As a result, the heat design of the whole image forming apparatus 10 is facilitated. Accordingly, the size of the casing can be further reduced, the parts can be appropriately arranged, and the number of cooling fans (not shown) can be reduced.

Furthermore, according to the image forming apparatus 10 of the first embodiment, the carbon lamp heater 31 is covered by the reflecting plate 32 so that a side wall of the reflecting plate 32 separates the carbon lamp heater 31 from the cleaning unit 18. See FIG. 1. Accordingly, the radiant heat emanating towards the cleaning unit 18 is reduced as compared with a structure without the reflecting plate 32. Also, the bottom of the reflecting plate 32 reflects the peak radiant energy traveling in a direction opposite to the photosensitive drum 12 towards the photosensitive drum 12, thereby further increasing the moisture removal performance by means of heating.

Still furthermore, according to the image forming apparatus 10 of the first embodiment, the temperature of the photosensitive drum 12 during a print operation is adjusted by using the heating unit 30 used for preheating. Consequently, a heating unit dedicated to the temperature adjustment during a print operation is not required. In addition, when the image forming apparatus 10 resumes operation from a power-saving mode, the photosensitive drum 12 is slowly rotated at the resume speed V2, which is significantly lower than the print speed V0 for forming an image. Therefore, the radiation energy is more concentrated on the surface of the photosensitive drum 12 compared with the case where the photosensitive drum 12 rotates at the higher print speed V0. Thus, moisture removal by heating is efficiently performed in a short time.

In other words, when the photosensitive drum 12 is rotated at the print speed V0, even the aluminum base 12*e* is sufficiently heated due to heat conduction at every rotation. However, when the photosensitive drum 12 is slowly rotated at the resume speed V2, water molecules on the surface of the photosensitive drum 12 receive a large amount of radiation energy and the temperature of the radiation area rapidly rises before the heat is transferred to the aluminum base 12*e* of the photosensitive drum 12. Thus, the evaporation of water molecules and the liberation from the composition are accelerated. Subsequently, when the previously irradiated area moves away from the radiation area, the aluminum base 12*e* functions as a heat sink, which rapidly decreases the surface temperature of the area to 40° C. due to heat conduction.

According to the image forming apparatus 10 of the first embodiment, the preheat time during a startup operation from a power-off mode is 6 minutes, whereas the preheat time during a resume operation from a power-saving mode is 30 seconds. Accordingly, by decreasing the rotational speed of the photosensitive drum 12 during the resume operation from a power-saving mode compared with that at the startup time, the surface temperature increases more rapidly, and therefore, the moisture removal can be completed in a short time. Conversely, since the preheat time during a startup operation from the power-off mode (6 minutes) is longer than the preheat time during a resume operation from a power-saving mode (30 seconds), the rotational speed of the photosensitive drum 12 at the startup time is set to be higher than that at the resume time from a power-saving mode so as to evenly heat the surface of the photosensitive drum 12.

This is because, if the surface temperature of the photosensitive drum 12 is uneven due to the power going on and off for temperature adjustment, and proper temperature adjustment is difficult and not obtained, the electrostatic charge retention capability of the photosensitive drum 12 becomes non-uniform, and therefore, the density of a formed image may be abnormal.

While the image forming apparatus 10 of the first embodiment has been described with reference to a temperature sensor 41 which is a non-contact thermistor located at a position distant from the surface of the photosensitive drum 12 by 2 mm, the distance is not intended to be limited to such a value. For example, the distance may be 2 to 5 mm. Additionally, the type of the temperature sensor may be changed to another infrared type. Alternatively, the temperature sensor may be in contact with the surface of the photosensitive drum 12, or the temperature sensor may be mounted inside the photosensitive drum 12. When the temperature sensor is in contact with the surface of the photosensitive drum 12, it is desirable that the temperature sensor be mounted outside the maximum image forming width in the length direction.

According to the image forming apparatus 10 of the first embodiment, the carbon lamp heater 31 with 300 watts is applied to perform on and off control using the rated voltage. However, the carbon lamp heater 31 may be replaced with anther carbon lamp heater with about 31 to 800 watts. Also, a voltage other than the rated voltage may be applied to operate the carbon lamp heater 31. Moreover, the heat amount may be controlled in an analog fashion by continuously changing the electrical current.

To prevent image deletion, the length of the carbon heating element 33 of the carbon lamp heater 31 is longer than the image forming width of the photosensitive drum 12. However, to prevent an unnecessary increase in temperature, the length of the carbon heating element 33 can be shorter than the length of the photosensitive drum 12. Additionally, the single carbon lamp heater 31 may be replaced with a plurality of shorter carbon lamp heaters arranged in series.

Additionally, the distribution of the heating value of the carbon lamp heater 31 in the lengthwise direction may be homogeneous. However, the heat is easily dissipated from support portions (not shown) at both ends of the photosensitive drum 12. Therefore, to obtain homogeneous distribution of temperature of the entire photosensitive drum 12, heating values at both ends of the carbon lamp heater 31 can be higher than the heating value at the middle portion of the carbon lamp heater 31.

Additionally, the carbon lamp heater 31 can be arranged between the cleaning unit 18 and the primary charger 19. This is because, if the carbon lamp heater 31 is arranged upstream of the cleaning unit 18, the remaining toner on the surface of the photosensitive drum 12 may adhere to the photosensitive drum 12 due to the radiant heat and the increase in the surface temperature. If the carbon lamp heater 31 is arranged downstream of the primary charger 19, the emitted light and radiant heat from the carbon lamp heater 31 may affect the electrostatic latent image.

In the first embodiment, the carbon lamp heater 31 is disposed at a position distant from the surface of the photosensitive drum 12 by 20 mm. In consideration of the heating efficiency and the increase in temperature, the carbon lamp heater 31 can be disposed at a position distant from the surface of the photosensitive drum 12 by 0.1 to 150 mm. The most suitable range is from 0.2 to 50 mm.

When the carbon lamp heater 31 is arranged between the cleaning unit 18 and the primary charger 19, the carbon lamp heater 31 can also function as the discharge exposure lamp 22. For example, a light-emitting filament may be accommodated in the enclosure 34 of the carbon lamp heater 31 together with the carbon heating element 33 to generate both heat and exposure light.

Second Exemplary Embodiment

FIG. 7 illustrates the result of experiments by an image forming apparatus according to a second exemplary embodiment of the present invention.

To determine the effect of the carbon lamp heater 31 shown in FIG. 5, a series of experiments was conducted by the present inventor to determine whether image deletion occurs or not depending on various structures of a heating unit.

A copying machine (iR8500 available from CANON KABUSHIKI KAISHA) was modified, as shown in FIG. 1. After the surface temperature of the photosensitive drum 12 was adjusted to 40° C. using the carbon lamp heater 31 having the distribution of anisotropic radiation intensity, images were continuously formed on 5000 sheets of material. Subsequently, the main body and the carbon lamp heater 31 were powered off and were left unused overnight in a high-temperature and high-humidity environment with a temperature of 30° C. and a relative humidity of 80%. On the following day, the carbon lamp heater 31 was powered on prior to the powering on the main body to adjust the surface temperature of the photosensitive drum 12 until it was stable at 40° C. The photosensitive drum 12 was then preheated while the photosensitive drum 12 was rotated at a normal speed in an idling manner for 2 minutes. Then, the quality of the image of the first printout was evaluated.

According to the results of the experiment, as can be seen from FIG. 7, the nighttime power consumption was zero (0). The image deletion did not occur. The cleaning unit 18 remained at normal temperature after the 2-minute preheating. The toner adhesion on the cleaning unit 18 did not occur.

Next, the carbon lamp heater 31 was replaced with the same wattage carbon lamp heater 31P having the distribution of isogonic radiation intensity. An experiment was conducted under the same conditions. That is, after the surface temperature of the photosensitive drum 12 was adjusted using the carbon lamp heater 31P, images are continuously formed on 5000 sheets of material. Subsequently, the main body and the carbon lamp heater 31P were powered off and were left unused in the same high temperature and high humidity environment. On the following day, the carbon lamp heater 31P was powered on prior to the powering on the main body to adjust the surface temperature of the photosensitive drum 12 until it was stable at 40° C. The photosensitive drum 12 was preheated while the photosensitive drum 12 was rotated at a normal speed in an idling manner for 2 minutes. Then, the quality of the image of the first printout was evaluated. Additionally, the carbon lamp heater 31 was replaced with the same wattage halogen lamp heater. An experiment was then conducted under the same conditions.

According to the results of the experiments, as can be seen from FIG. 7, image deletion did not occur for the carbon lamp heater 31P. However, minor toner adhesion occurred on the cleaning unit 18. In contrast, for the halogen lamp heater, the preheat was insufficient, and therefore, image deletion occurred. The outer wall of the cleaning unit 18 adjacent to the heating unit 30 became so hot that the present inventor could not touch the outer wall. Thus, in this case, overheating in the vicinity of the lamp was serious. Major toner adhesion occurred on the cleaning unit 18.

A further experiment was conducted. The carbon lamp heater 31 was removed from the same copying machine and a nichrome heater was attached to an inner peripheral surface of the photosensitive drum 12. The experiment was conducted under the same conditions except that preheating was not performed. In addition, the nichrome heater was powered on overnight to adjust the temperature of the photosensitive drum 12, and the quality of an image was evaluated.

As can be seen from FIG. 7, when the photosensitive drum 12 was heated overnight, moisture absorption of the photosensitive drum 12 was prevented. Accordingly, image deletion did not occur during the first image formation. Since the heat did not affect the area outside the photosensitive drum 12, toner adhesion was not found on either the interior of the cleaning unit 18 or the photosensitive drum 12. However, since the power was consumed overnight, the overnight power consumption reached 200 watts.

In contrast, when the heater was powered off overnight and preheating was not performed, a serious image deletion occurred in the first image formation immediately after the nichrome heater was powered on and the temperature of the photosensitive drum 12 reached 40° C.

Third Exemplary Embodiment

Figure 8:
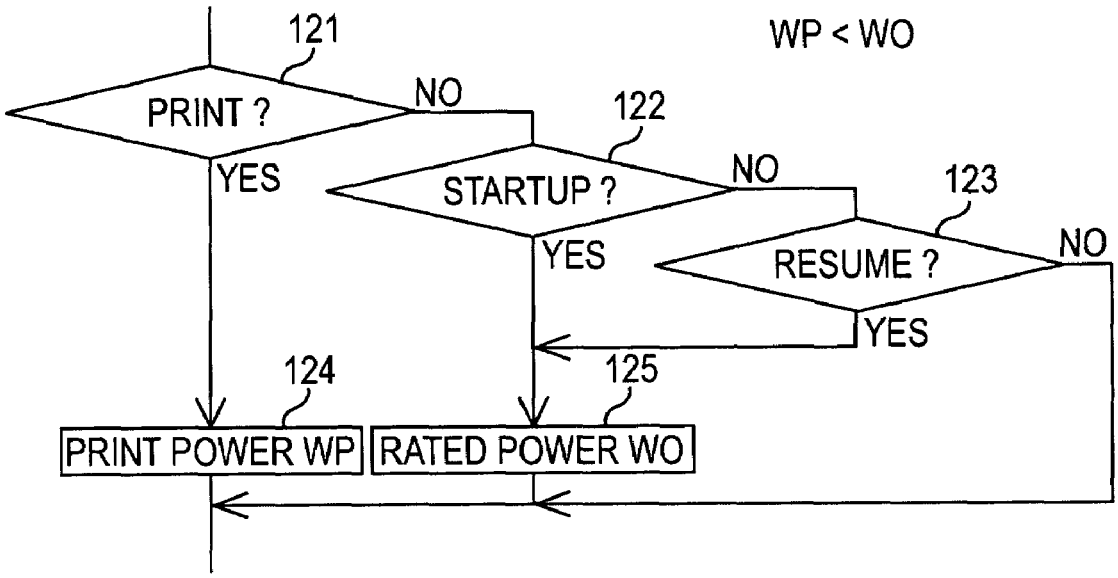
FIG. 8 illustrates the heat control in an image forming apparatus according to a third exemplary embodiment of the present invention.

FIG. 8 illustrates the control of lamp heater heating means in an image forming apparatus according to a third exemplary embodiment of the present invention.

According to the third embodiment, the structure of an image forming apparatus is similar to that of the image forming apparatus of the first embodiment shown in FIGS. 1 through 5. In this embodiment, the speed control of the photosensitive drum 12 shown in FIG. 6 and the output control of a carbon lamp heater shown in FIG. 8 are added to this structure.

That is, the control unit 40 shown in FIG. 3 performs on and off control of switch 42 to apply a pulse current to the carbon lamp heater 31 and changes the width of the pulse so as to continuously adjust the output of the carbon lamp heater 31.

As shown in FIG. 8, at step 121, the control unit 40 determines whether the image forming apparatus 10 is performing a printing operation. If the image forming apparatus 10 is performing a printing operation, the process proceeds to step 124, where the control unit 40 sets up a print power WP. If the image forming apparatus 10 is not performing a printing operation, the process proceeds to step 122, where the control unit 40 determines whether the image forming apparatus 10 is starting up from a power-off mode. If the image forming apparatus 10 is starting up from a power-off mode, the process proceeds to step 125, where the control unit 40 sets up a rated power W0. If the image forming apparatus 10 is not starting up from a power-off mode, the process proceeds to step 123, where the control unit 40 determines whether the image forming apparatus 10 is resuming operation from a power-saving mode. If the image forming apparatus 10 resumes operation from a power-saving mode, the process proceeds to step 125, where the control unit 40 sets up the rated power W0. It is noted that the print power WP is determined to be 50% of the rated power W0.

According to the third embodiment, as described in the first embodiment, when the image forming apparatus 10 having such a configuration starts up from a power-off mode, the control unit 40 maintains the switch 42 on to illuminate the carbon lamp heater 31. The control unit 40 then rotates the photosensitive drum 12 for 6 minutes.

Upon completion of the preheating, control unit 40 accelerates the rotational speed of the photosensitive drum 12 to the print speed V0 and controls on and off operation of the switch 42 using a pulse of 20% duty to reduce the power of the carbon lamp heater 31. At the same time, the control unit 40 references the output of the temperature sensor 41 to start temperature control so that the surface temperature of the photosensitive drum 12 is maintained at 40° C. That is, if the temperature detected by the temperature sensor 41 exceeds 42° C., the control unit 40 turns off switch 42. If the temperature falls below 38° C., the control unit 40 turns on switch 42.

According to the third embodiment, the image forming apparatus 10 is controlled as described above. Since the control unit 40 controls the surface temperature of the photosensitive drum 12 using the print power WP that is about 20% of the rated power W0, the variation in the temperature distribution on the periphery of the photosensitive drum 12 is reduced. That is, compared with the control using the rated power W0, the on-operation time and off-operation time of the carbon lamp heater 31 become long. Therefore, the event in which each operation has an effect on only part of the periphery of the photosensitive drum 12 can be prevented.

In the third embodiment, the electric power of the carbon lamp heater 31 is decreased by controlling the on/off operation of the switch 42. However, the electric power of the carbon lamp heater 31 may be decreased in an analog fashion by controlling an electrical current. Alternatively, the electric power of the carbon lamp heater 31 may be continuously changed by a pulse-width modulation (PWM) control, a phase control, or a wavenumber control while referencing the output of the temperature sensor 41.

Fourth Exemplary Embodiment

Figure 9:
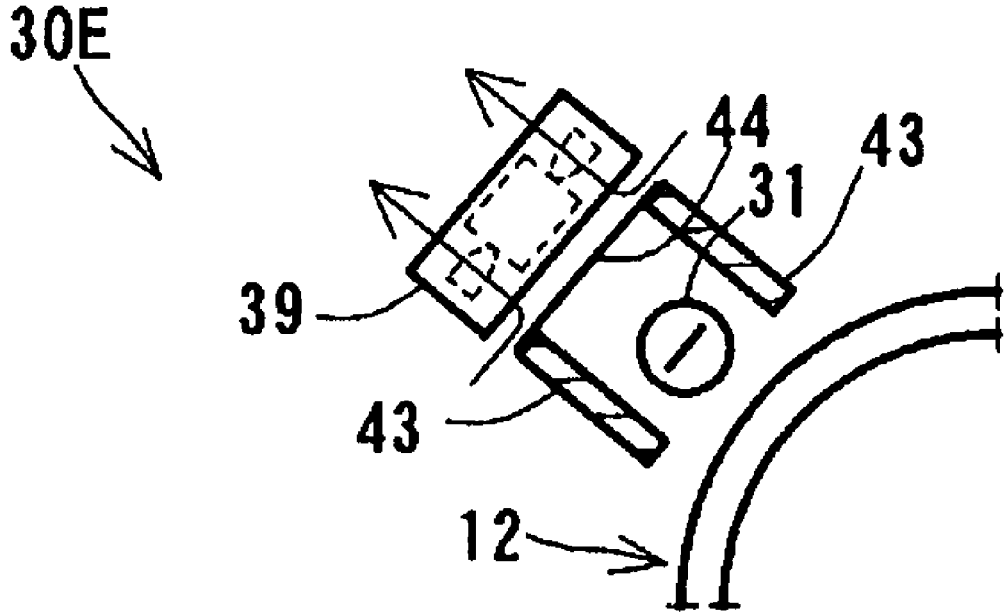
FIG. 9 illustrates a heating unit of an image forming apparatus according to a fourth exemplary embodiment of the present invention.

FIG. 9 illustrates a heating unit of an image forming apparatus according to a fourth exemplary embodiment of the present invention.

In the image forming apparatus according to the fourth embodiment, the heating unit 30 of the image forming apparatus 10 shown in FIG. 1 is replaced with a heating unit 30E shown in FIG. 9.

As shown in FIG. 9, the carbon lamp heater 31 is covered by a thermal insulator 43 in the circumferential direction of the photosensitive drum 12 and is covered by a reflecting plate 44 on the side remote from the photosensitive drum 12. Additionally, an air-cooling fan 39 is provided on the rear of the reflecting plate 44.

According to the fourth embodiment, in the image forming apparatus 10 having such a configuration, the thermal insulator 43 reduces the heat outflow in the circumferential direction of the photosensitive drum 12 and the air-cooling fan 39 removes the heat from the reflecting plate 44. Accordingly, temperature rises of parts and units in the vicinity of the heating unit 30E can be reduced.

In the image forming apparatus 10 according to the fourth embodiment, the air-cooling fan 39 cools the reflecting plate 44. However, an air-cooling fan 39 may cool the thermal insulator 43. Additionally, the air-cooling fan 39 may be replaced with an airflow duct or a radiating fin using natural convection.

While the present invention has been described with reference to exemplary embodiments, it is to be understood that the invention is not limited to the disclosed exemplary embodiments. The scope of the following claims is intended to encompass all modifications, equivalent structures and functions.

This application claims the benefit of Japanese Application No. 2004-381909 filed Dec. 28, 2004, which is hereby incorporated by reference herein in its entirety.

What is claimed is:

1. An image forming apparatus comprising:

an image bearing member on which an electrostatic latent image is formed;

an image forming unit configured to form a toner image on a recording material on the basis of the electrostatic latent image formed on the image bearing member; and a lamp heater configured to heat a surface of the image bearing member with radiant heat, wherein the lamp heater has a radiation spectrum that exhibits a radiation intensity which is no less than 80% of a maximum radiation intensity in at least a part of a range of wavelength from 2 to 3.5μm.

2. The image forming apparatus according to claim 1, wherein the lamp heater is disposed opposite an outer surface of the image bearing member.

3. An image forming apparatus comprising:

an image bearing member on which an electrostatic latent image is formed;

an image forming unit configured to form a toner image on a recording material on the basis of the electrostatic latent image formed on the image bearing member; and a lamp heater configured to heat a surface of the image bearing member with radiant heat, wherein a heating element of the heating lamp has an amount of radiant heat directed to the surface of the image bearing member being higher than an amount of radiant heat directed to a circumferential direction of the image bearing member.

4. The image forming apparatus according to claim 3, wherein the heating element is shaped like a plane board.

5. The image forming apparatus according to claim 3, wherein the lamp heater is disposed opposite an outer surface of the image bearing member.

6. The image forming apparatus comprising:

an image bearing member on which an electrostatic latent image is formed;

an image forming unit configured to form a toner image on a recording material on the basis of the electrostatic latent image formed on the image bearing member; and a lamp heater configured to heat a surface of the image bearing member with radiant heat, wherein a heating element of the lamp heater is a carbon heating element.

7. The image forming apparatus according to claim 6, wherein the lamp heater is disposed opposite an outer surface of the image bearing member.

* * * * *

UNITED STATES PATENT AND TRADEMARK OFFICE

CERTIFICATE OF CORRECTION

PATENT NO. : 7,398,031 B2
APPLICATION NO. : 11/300497
DATED : July 8, 2008
INVENTOR(S) : Matsuura It is certified that error appears in the above-identified patent and that said Letters Patent is hereby corrected as shown below:

COLUMN 5:
Line 59, “remaining the” should read --the remaining--.

COLUMN 6:
Line 6, “photosensitive drum 12” should read --photosensitive drum 12,--.

COLUMN 8:
Line 36, “in section” should read --section--.

COLUMN 14:
Line 21, “WP.If” should read --WP. If--.

COLUMN 16:
Line 39, “a” (first occurrence) should read --¶ a--.

Signed and Sealed this

Seventeenth Day of February, 2009

JOHN DOLL
*Acting Director of the United States Patent and Trademark Office*